United States Patent [19]

Coleman

[11] Patent Number: 4,755,157

[45] Date of Patent: Jul. 5, 1988

[54] ICEBREAKING DEFENSE BUOY

[75] Inventor: Richard K. Coleman, Thousand Oaks, Calif.

[73] Assignee: Exxon Production Research Company, Houston, Tex.

[21] Appl. No.: 32,915

[22] Filed: Mar. 31, 1987

Related U.S. Application Data

[63] Continuation of Ser. No. 617,055, Jun. 4, 1984, abandoned.

[51] Int. Cl.[4] ..... E02B 15/02

[52] U.S. Cl. ..... 441/23; 405/61; 405/211

[58] Field of Search ..... 491/1, 22, 23; 405/26, 405/27, 61, 211, 217; 114/293

[56] References Cited

U.S. PATENT DOCUMENTS

| | | | |
|---|---|---|---|
| 310,551 | 1/1885 | Averell | 405/26 |
| 325,162 | 8/1885 | Delany | 441/1 |
| 1,432,530 | 10/1922 | Chance | 405/27 |
| 2,449,963 | 9/1948 | Ward | 405/61 |
| 3,022,632 | 2/1962 | Parks | 405/26 |
| 3,151,594 | 10/1964 | Collipp | 114/293 |
| 3,845,633 | 11/1974 | Hammond | 405/211 |
| 4,033,023 | 7/1977 | Slaughter et al. | 441/1 |
| 4,093,463 | 5/1978 | Soderberg | 114/293 |
| 4,487,151 | 12/1984 | Deiana | 405/26 |
| 4,547,093 | 10/1985 | Statham | 405/61 |

FOREIGN PATENT DOCUMENTS

| | | | |
|---|---|---|---|
| 960370 | 9/1982 | U.S.S.R. | 405/61 |

OTHER PUBLICATIONS

"Samson Fenders Flotation Special Applications" brochure, pp. 8 and 9.

*Primary Examiner*—Joseph F. Peters, Jr.
*Assistant Examiner*—Thomas J. Brahan
*Attorney, Agent, or Firm*—John S. Schneider; Herbert E. O'Niell

[57] ABSTRACT

An icebreaking buoy system includes an icebreaking buoy connected to clump weight means positioned on the sea floor by a mooring line having minimum extra length sufficient to permit the buoy to ride up over the largest expected wave. Several such buoy systems may be used to form a line along one or more sides of, or a ring entirely around, an offshore structure or rig to break an ice sheet in the direction or directions it is moving. An anchor fixed to the sea floor may be connected to the clump weight means. Each buoy has a downward sloping bottom portion and a cylindrically or spherically formed top portion. The sides or ends and the bottom of the buoy may be beveled, conical or spherical.

9 Claims, 1 Drawing Sheet

FIG. 1
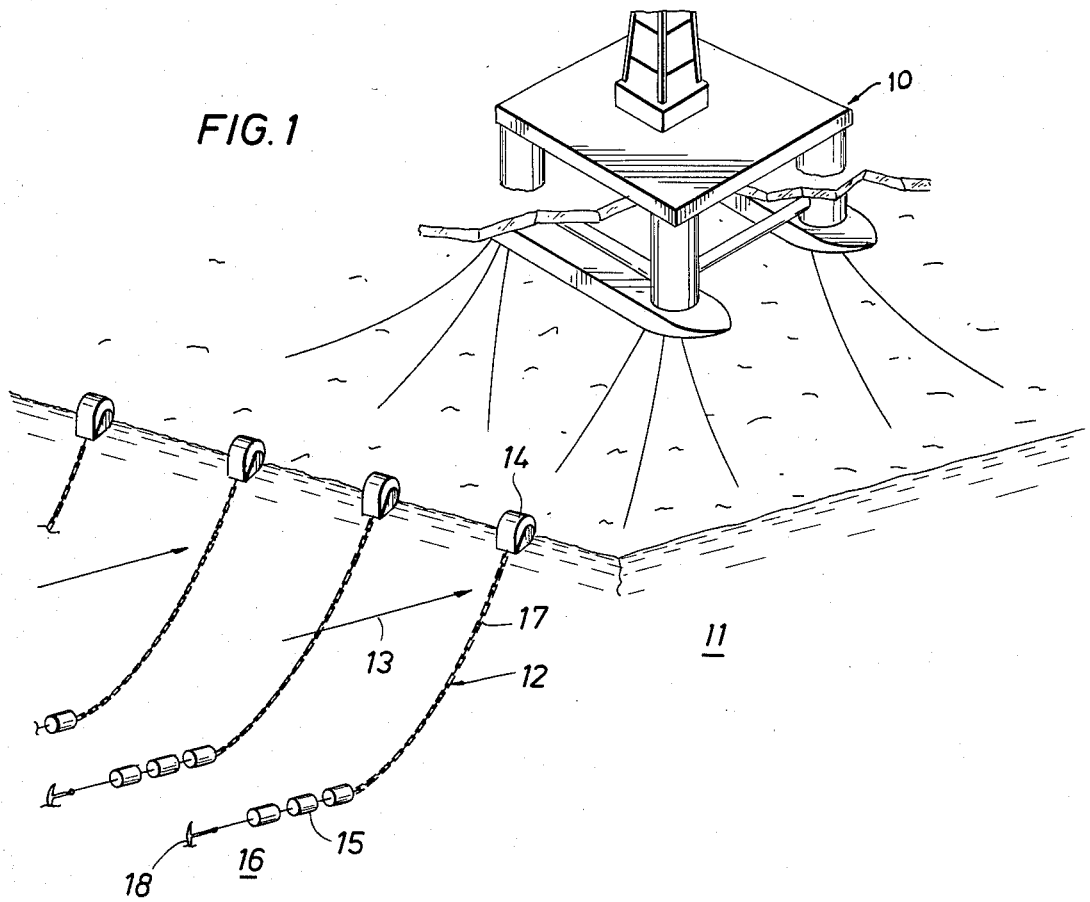
FIG. 2
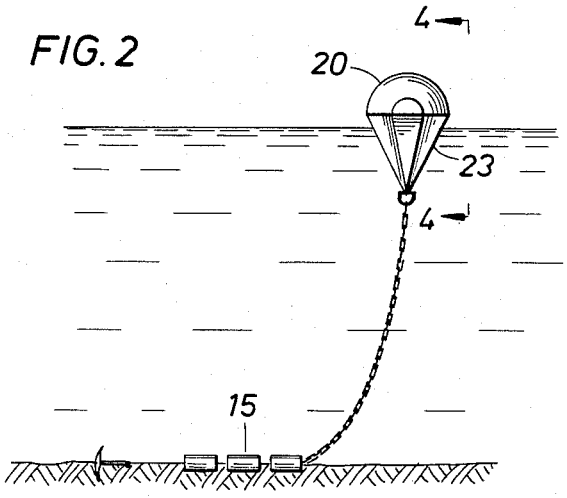
FIG. 3
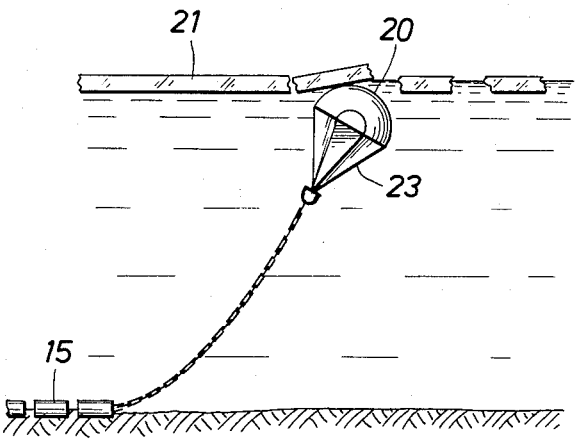
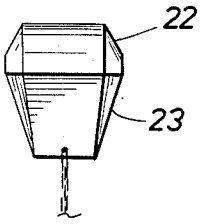
FIG. 4

ICEBREAKING DEFENSE BUOY

This application is a continuation of co-pending application Ser. No. 617,055, filed on June 4, 1984, now abandoned.

BACKGROUND OF THE INVENTION

Exploratory drilling systems for the Arctic Seas (e.g., the Bering and Chukchi Seas) include floating rigs such as drill ships and semi-submersibles. Although these systems can be designed to resist some ice loading, their capability to remain on location in the presence of a continuous ice cover is doubtful. As a result, the use of several icebreaking vessels to maintain broken ice cover has been proposed. This, however, raises questions as to the icebreaking vessel's reliability, ability to maneuver, expense, and the number of such support vessels required for each drilling system. In short, the problem is how to minimize the amount of active support required to keep a floating drilling system operable. Whether this is limited to relief well drilling or is applied to year-roudn use, a reduction in the amount of ice that needs to be broken by active vessels will greatly enhance floating operations. Furthermore, such an aid would allow floating production concepts to get continued consideration or deeper areas.

Moving ice sheets also present a problem for grounded or fixed offshore drilling and production platforms and loading terminals. Such marine platforms can be designed to withstand moving ice masses; marine platform support legs can be protected from damage from ice by use of fenders and special coatings, for example. Nonetheless, a body of relatively thick ice being urged against a structure still presents a tendency for applying a lateral displacing or overturning force.

The present invention is directed to overcome the aforementioned problems, and particularly with respect to floating rigs. The invention is a simple mechanism conceived to continuously break up a moving ice sheet at a given location.

SUMMARY OF THE INVENTION

Three fundamental components are used to provide a maintenance free icebreaking aid. They are: (1) an icebreaking buoy floating on the water surface, (2) a mooring line with minimum extra length, and (3) a suitable anchor means to rest on the sea floor connected to the buoy by the mooring line. The buoy breaks sheet ice either (1) from underneath as it is overridden by ice or (2) from above if it becomes frozen in. In either case, the buoy system works without any maintenance, resupply or adjustment from the moment it is installed until it is removed.

This buoy icebreaking system is conceived as an aid to maintaining broken ice. Although first-year ice ridges will not harm the buoy, these ridges might pass right over it. Therefore, an ice-breaking support vessel must still break approaching ridges while the buoys break the sheet ice. In some applications, the support vessel may need to break the broken sheet into smaller pieces but it will have much less difficulty maneuvering since the buoys will have broken the ice. Also, the support vessle will need to free any buoys that become frozen into ridges; however, the ice must be moving very slowly for freeze-in to occur so there would be plenty of time to free them.

This buoy concept will be very useful in providing a dependable icebreaking assistance in order to minimize the number of icebreaking vessels required in the Arctic Seas.

BRIEF DESCRIPTION OF THE DRAWINGS

FIG. 1 illustrates an offshore floating rig protected by several of the icebreaking buoy systems;

FIG. 2 is a vertical elevation of one of the icebreaking buoy systems shown in FIG. 1;

FIG. 3 is a vertical elevation illustrating the icebreaking buoy system in operation; and FIG. 4 is a view taken on lines 4—4 of FIG. 2.

DESCRIPTION OF THE PREFERRED EMBODIMENTS

There is shown in FIG. 1 an offshore structure 10, such as a floating rig used in drilling operations, arranged in a body of water designated 11. A number of icebreaking buoy systems, generally designated 12, are aligned along one or more sides of the offshore structure which is in the path of direction of ice movement indicated by arrows 13. Each icebreaking buoy system consists of a buoy member 14 floating on the surface of water 11 connected to an anchor arrangement 15, preferably a clump weight, positioned on the sea floor 16, by means of a mooring line 17, preferably a chain. The clump weight is a series of articulated links having selected length, width and weight to accommodate any particular icebreaking buoy system. The articulation allows individual links to peel off the sea floor, thus allowing the downward force on the buoy to vary as required. A small conventional buoy anchor 18 may be used to aid in placing the clump weight anchor 15 in position.

As seen in FIGS. 2 and 3, chain 17 must have sufficient strength to withstand the design breakout force of buoy 14 in ice and also must be capable of lifting clump weight 15. The length of the chain 17 should be just enough to let buoy 14 ride up over the largest expected waves. This will minimize uplift forces at the sea floor 16 and keep buoy 14 close to its intended icebreaking location.

Although the shape of buoy 14 can be variable, a preferred shape is illustrated in FIGS. 2, 3 and 4. As shown in those figures, the top 20 is cylindrical for applying large contact forces to the edge or bottom of an ice sheet 21 (FIG. 3). The ends or sides are beveled as at 22, (but maybe conical or spherical), to reduce any breakout problems. The bottom 23 is sloped down so the mooring connection remains below the ice level. As shown in FIG. 4, the bottom may be comprised of two longitudinally extended plates connected at their bottom ends adjacent the mooring connection and connected at their upper ends to the cylindrical top 20. The top may be spherically configured and the bottom conically configured, as in the shape of an ice cream cone. As shown in FIGS. 1 through 4, the top of the buoy is preferably curved and free of projections therefrom that could engage and decelerate a moving ice sheet. Preferably, the icebreaking buoy will ride under the ice without snagging or grabbing the ice. As was mentioned above, in the event the ice is moving very slowly and freeze-in of the buoy occurs, the mooring line must have sufficient strength to withstand the breakout force of the buoy in ice. All internal stiffening of the buoy is designed to provide upward bearing or downward pull out strength. Since ice crushing should not occur, the plating on the buoy can be relatively thin.

Each buoy system is designed to provide enough buoyancy to bend and break the ice 21 from underneath when overriden by the ice sheet. Approximations of the upward breaking strength of ice can be made using the existing downward bearing capacity relationship for load capacity P:

$P=50\ h^2$ (P=load in pounds, h=thickness in inches)

Thus, for 48 inches of level ice, on the order of 115 kips would be required to break the ice sheet. For general sizing, a buoy roughly equivalent to a 16-foot diameter cylinder that is 20 feet long would be required. Such a buoy would have a buoyancy of about 260 kips and a steel weight of about 60 kips which would allow about 75% of the buoy volume to float above water.

Since a frozen-in buoy could create large break out loads, those loads must be resisted before the seabed anchor 15 is pulled free. This weight must be greater than the bearing strength of the ice sheet. A weight of about 200 kips would be adequate.

Various modifications of the invention set forth above may be made without departing from the scope of the invention as defined in the appended claims.

I claim:

1. An icebreaking buoy system for deployment in a body of water adjacent an offshore structure for protecting the structure from moving ice sheets having thicknesses not exceeding a preselected maximum thickness, comprising at least one buoy for breaking ice sheets, having buoyancy sufficient to bend and break an ice sheet of the preselected maximum ice thickness by exerting an upward force when the buoy is submerged beneath such ice sheet, wherein the buoy has a curved top configured to ride under the moving ice sheet and free of projections therefrom that could engage and decelerate the moving ice sheet and a bottom connected to the top and including a mooring connection at the lower end of said bottom;

at least one anchor connected to the sea floor for exerting sufficient downward force on the buoy to resist the buoyancy of the buoy and the breakout forces on the buoy by an ice sheet in the event the buoy becomes frozen into the ice sheet; and at least one mooring line having strength sufficient to withstand the breakout forces on the buoy from the ice, if the buoy becomes frozen into the ice, and connected between the anchor and the mooring connection at the lower end of the buoy and having a length just sufficient to allow the buoy to ride over the largest expected waves in the water adjacent the structure, and to maintain the mooring connector at a depth below the bottom of ice of maximum thickness, whereby the buoy will ride under, bend, and break the moving ice sheets and the mooring connection is prevented from becoming frozen into the ice.

2. The ice breaking bouy system of claim 1 wherein the buoy has a spherical upper end.

3. The ice breaking buoy system of claim 2 wherein the buoy has tapered sides.

4. The icebreakng buoy system of claim 2 wherein the buoy has the lower end having a conical shape.

5. The ice breaking buoy system of claim 1 wherein the buoy has a cylindrical top.

6. The ice breaking buoy system of claim 5 wherein the bottom of the buoy is sloped downwardly to the moorng connection to maintain the mooring connector beneath the ice.

7. The ice breaking buoy system of claim 5 wherein the buoy has a lower end having a conical shape.

8. The icebreaking buoy system of claim 5 wherein the bottom of the buoy comprises two longitudinally extended plates connected to each other at their lower ends adjacent the mooring connection and to the cylindrical top of the buoy at their upper ends and wherein the buoy further comprises beveled sides connected to the cylindrical top and the bottom.

9. A method for breaking a movng sheet of ice around an offshore structure, comprising the steps of:

selecting a maximum ice thickness value corresponding to the maximum ice thickness that needs to be broken;

calculating the upward force required to be exerted on an ice sheet of the maximum ice thickness in order to bend and break the ice sheet;

providing an icebreaking buoy having a buoyancy at least equal to the upward force figure calculated in the preceding step and further including a curved top free of projections that could engage and decelerate the moving ice for riding under, bending and breaking the moving ice sheet and a bottom connected to the top and having a mooring connection at the lower end thereof for connection to the sea floor; and anchoring the buoy in the path of the moving ice adjacent the structure with a mooring line connected to the mooring conneciton on the lower end of the buoy at a point below the depth of the bottom surface of an ice sheet of the maximum ice thickness and to the sea floor and having a length sufficient to just permit the buoy to ride over the largest expected waves in the water adjacent the structure and maintain the mooring connector on the lower end of the buoy below the depth of the bottom of an ice sheet of the maximum ice thickness.

* * * * *